US011642722B2

(12) United States Patent
Uchinaka et al.

(10) Patent No.: US 11,642,722 B2
(45) Date of Patent: May 9, 2023

(54) FLUID BLOW-OUT STRUCTURE

(71) Applicant: HONDA MOTOR CO., LTD., Tokyo (JP)

(72) Inventors: Yusuke Uchinaka, Tochigi (JP); Suguru Takano, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 59 days.

(21) Appl. No.: 17/442,875

(22) PCT Filed: Dec. 25, 2019

(86) PCT No.: PCT/JP2019/050848
§ 371 (c)(1),
(2) Date: Sep. 24, 2021

(87) PCT Pub. No.: WO2020/194954
PCT Pub. Date: Oct. 1, 2020

(65) Prior Publication Data

US 2022/0152696 A1 May 19, 2022

(30) Foreign Application Priority Data

Mar. 28, 2019 (JP) ..... JP2019-062428

(51) Int. Cl.
*B22D 13/10* (2006.01)
*B22C 23/02* (2006.01)

(52) U.S. Cl.
CPC ..... *B22D 13/10* (2013.01); *B22C 23/02* (2013.01)

(58) Field of Classification Search
CPC ..... B22D 13/10; B22D 13/107
See application file for complete search history.

(56) References Cited

FOREIGN PATENT DOCUMENTS

| | | |
|---|---|---|
| JP | S54-112725 | 9/1979 |
| JP | 2004-141881 | 5/2004 |
| JP | 2014-231063 | 12/2014 |

OTHER PUBLICATIONS

International Search Report, dated Mar. 17, 2020, 2 pages.

*Primary Examiner* — Kevin P Kerns
*Assistant Examiner* — Steven S Ha
(74) *Attorney, Agent, or Firm* — Rankin, Hill & Clark LLP

(57) ABSTRACT

A fluid blow-out structure of a centrifugal casting device 1, for blowing out a fluid to inner surface of a rotating cylindrical mold 2, including: fluid application outer tube 5 inserted into the mold 2; movable mechanism 6 supporting a base end of the fluid application outer tube 5; outlet 8 through which the fluid is blown out, the outlet 8 provided at a leading end of the fluid application outer tube 5; fluid supply tube 9 inserted in the fluid application outer tube 5 and connected to the outlet 8; and guide mechanism 7 contacting an outer circumferential surface of the fluid application outer tube 5, and guides the fluid application outer tube 5 into and out of the mold 2. The fluid application outer tube 5 includes a resin hollow tube 10 and a metal tube 11 covering outer circumferential surface of the resin hollow tube 10.

7 Claims, 3 Drawing Sheets

FLUID BLOW-OUT STRUCTURE

TECHNICAL FIELD

The present invention relates to a fluid blow-out structure.

BACKGROUND ART

Conventionally, there is known a fluid blow-out structure to be used in a centrifugal casting device, the structure including: a fluid application outer tube that can be inserted into and removed from a mold; a movable mechanism that supports a base end of the fluid application outer tube; an outlet provided at a leading end of the fluid application outer tube; and a fluid supply tube installed in the fluid application outer tube and connected to the outlet, wherein the leading end of the fluid application outer tube is thinner than a basal portion thereof so as to achieve weight reduction (see, for example, JP 2004-141881 A).

CITATION LIST

Patent Literature

Patent Literature 1: JP 2004-141881 A

SUMMARY OF INVENTION

Technical Problem

The fluid application outer tube to be inserted into a centrifugal casting mold slides on a guide mechanism including a rail mechanism and a roller mechanism at the time of advance and retreat operation, so that friction is caused. In particular, a long fluid application outer tube has a problem in that since the fluid application outer tube is cantilevered at the base end, a leading end side portion of the fluid application outer tube is likely to bend downward due to gravity, so that abrasion is likely to be caused by friction with the guide mechanism when the fluid application outer tube is inserted into and removed from the mold.

Meanwhile, in order to manufacture a small product, it is necessary to reduce the diameter of the fluid application outer tube itself. Thus, for example, even if a material having high specific rigidity such as CFRP is used, the fluid application outer tube is vulnerable to friction and is worn in a short period of time. Thus, maintenance of the fluid application outer tube and the guide mechanism needs to be conducted in a relatively short time due to abrasion. This requires weight reduction and improvement in abrasion resistance of the fluid application outer tube as much as possible so as to shorten suspension time of casting work and reduce frequency of the maintenance. However, at the same time, the fluid application outer tube needs to have predetermined strength so as to bear the weight of fluid to be applied. Therefore, there is also a limit on reduction of wall thickness.

In view of the above points, the present invention has its object to provide a fluid blow-out structure of a centrifugal casting device, capable of further weight reduction and improvement in abrasion resistance.

Solution to Problem

[1] In order to achieve the above object, the present invention is a fluid blow-out structure of a centrifugal casting device, for blowing out a fluid to an inner surface of a rotating cylindrical mold, the structure including:

a fluid application outer tube that can be inserted into and removed from the mold;

a movable mechanism that supports a base end of the fluid application outer tube;

an outlet through which the fluid is blown out, the outlet being provided at a leading end of the fluid application outer tube;

a fluid supply tube inserted in the fluid application outer tube and connected to the outlet; and a guide mechanism that is in contact with an outer circumferential surface of the fluid application outer tube, and guides the fluid application outer tube into and out of the mold, wherein the fluid application outer tube includes a resin hollow tube and a metal tube that covers an outer circumferential surface of the resin hollow tube.

According to the present invention, since the fluid application outer tube includes the resin hollow tube and the metal tube that covers the outer circumferential surface of the resin hollow tube, the metal tube can be supported by the resin hollow tube formed by use of resin lighter than metal even if the wall thickness of the metal tube is reduced, so that it is possible to achieve weight reduction while ensuring the strength of the fluid application outer tube.

In addition, since the metal tube is disposed on the outer circumferential surface, it is also possible to ensure resistance to abrasion caused by friction with the guide mechanism.

[2] Furthermore, in the present invention, it is desirable that an inner circumferential surface of the resin hollow tube be formed in a tapered shape increasing in diameter toward a leading end, and the outer circumferential surface of the resin hollow tube be formed in such a way as to keep a diameter of the resin hollow tube constant throughout its length between a base end and the leading end such that the resin hollow tube is gradually thinned from the base end toward the leading end.

With such a configuration, the resin hollow tube is gradually thinned from the base end toward the leading end, but the outer diameter of the resin hollow tube is constant throughout its length between the base end and the leading end. Therefore, as compared with a case where the outer diameter of the resin hollow tube is not constant throughout its length between the base end and the leading end, it is easy to cover the outer circumference of the resin hollow tube with the metal tube while reducing the weight of the leading end. In addition, since the inner circumferential surface of the resin hollow tube can be tapered only by die cutting, processing is easy, leading to cost reduction.

[3] Furthermore, in the present invention, it is desirable that the metal tube be formed such that a leading end side portion is thinner than a base end side portion.

With such a configuration, it is possible to further reduce the weight of the fluid application outer tube as compared with a configuration in which the leading end of the metal tube is equal in thickness to the base end thereof. With this configuration, when a long fluid application outer tube is inserted into the mold, it is possible to prevent the insertion leading end side portion of the fluid application outer tube from bending. This enables uniform application even in the case of a long mold, particularly, a mold having a small diameter.

[4] Moreover, in the present invention, the metal tube may include a light metal tube portion and a heat-resistant metal portion, the heat-resistant metal portion covering an outer circumferential surface of the light metal tube portion and being formed of metal having higher heat resistance than the light metal tube portion.

With such a configuration, even when a long fluid application outer tube is inserted into a preheated centrifugal casting mold, it is possible to reduce the effect of heat on the resin hollow tube located inside. In addition, it is possible to achieve further weight reduction while maintaining the heat resistance of the fluid application outer tube, by forming a part of the metal tube with light metal.

DESCRIPTION OF EMBODIMENTS

Figure 1:
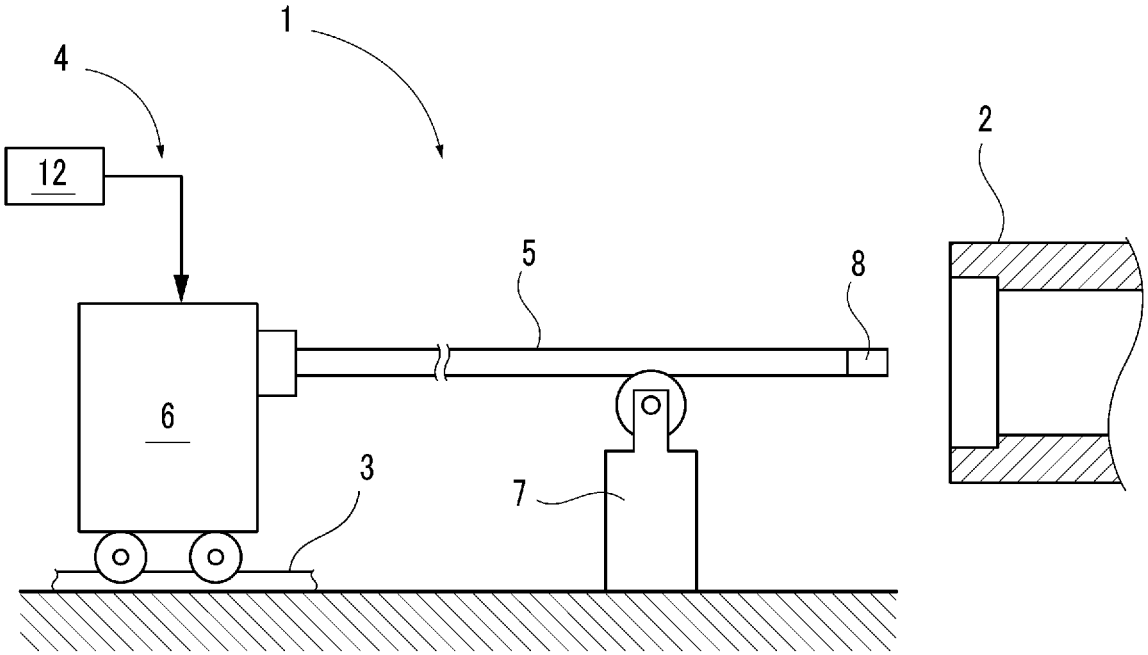
FIG. 1 is an explanatory diagram schematically illustrating a fluid blow-out structure of a centrifugal casting device according to an embodiment of the present invention.
Figure 2:
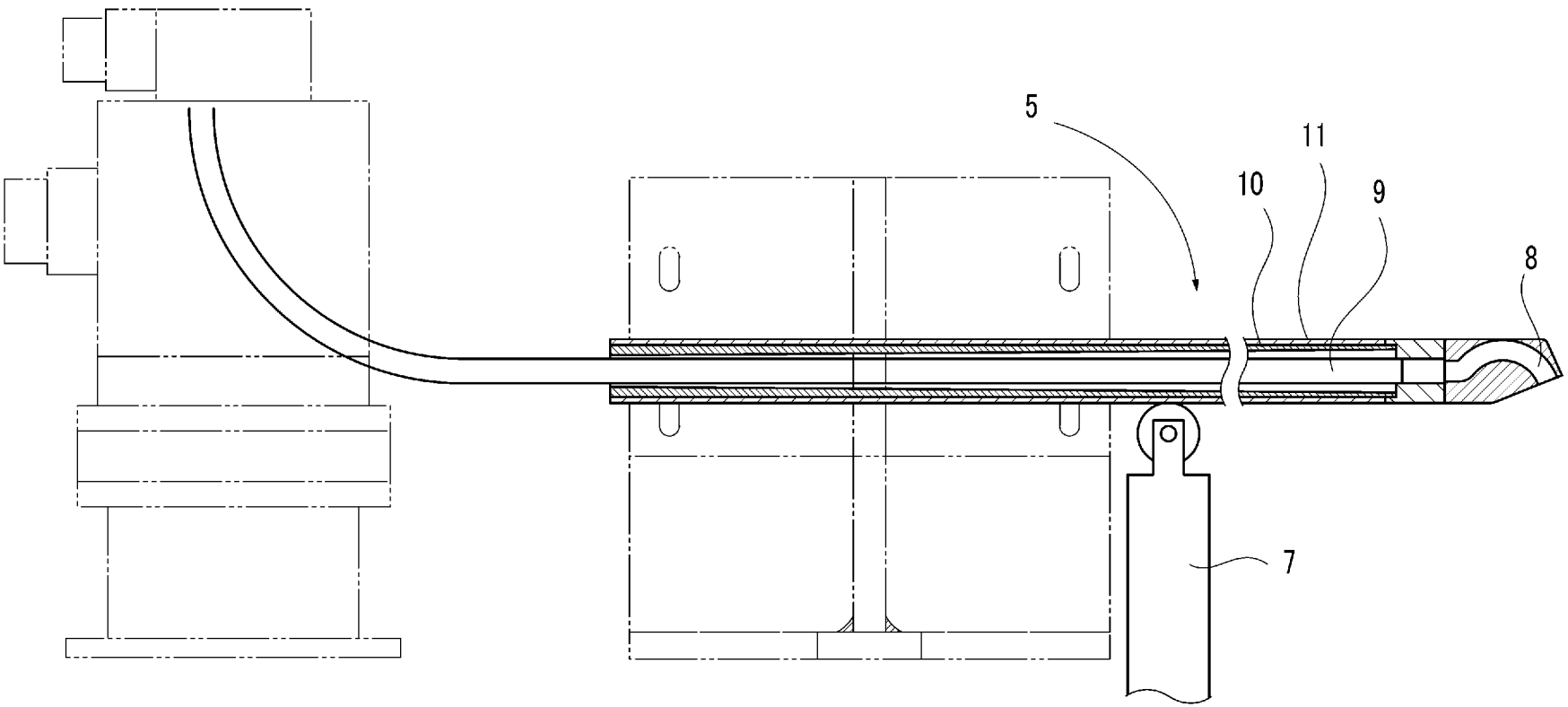
FIG. 2 is an explanatory diagram illustrating a fluid application outer tube of the present embodiment in cross section.
Figure 3:
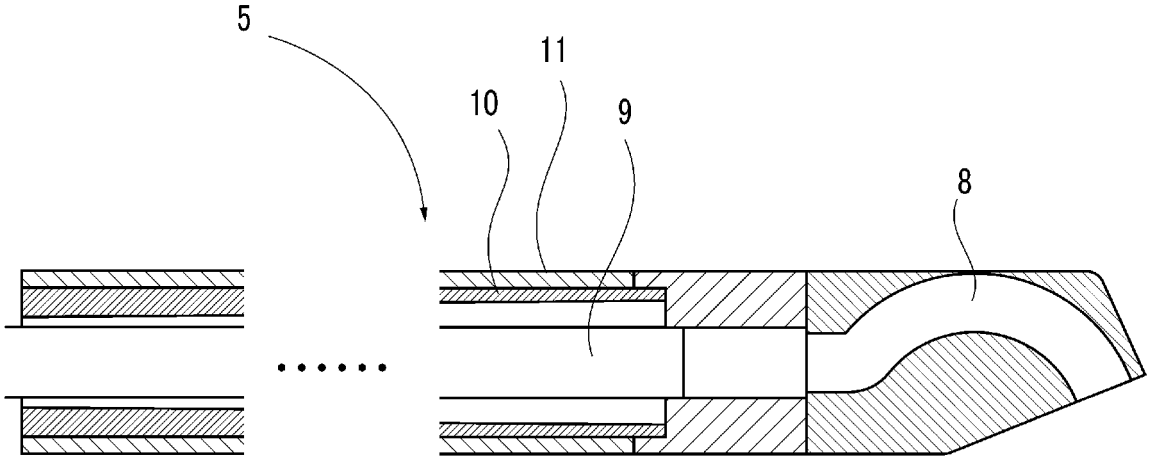
FIG. 3 is an explanatory diagram providing an enlarged view of the fluid application outer tube of the present embodiment.

A fluid application structure of a centrifugal casting device according to an embodiment of the present invention will be described with reference to the drawings.

A centrifugal casting device 1 of the present embodiment includes a centrifugal casting mold 2 and a fluid application device 4. The centrifugal casting mold 2 has a cylindrical shape. The fluid application device 4 applies a fluid to the inner circumferential surface of the centrifugal casting mold 2.

The fluid application device 4 includes a fluid application outer tube 5, a movable mechanism 6, a guide mechanism 7, and a control unit 12. The fluid application outer tube 5 can be inserted into the centrifugal casting mold 2. The movable mechanism 6 supports the base end of the fluid application outer tube 5, and is movable on a rail 3. The guide mechanism 7 is in contact with the outer circumferential surface of the fluid application outer tube 5, and guides the fluid application outer tube 5 into and out of the centrifugal casting mold 2. The control unit 12 controls advance and retreat movement of the movable mechanism 6 on the rail 3. The guide mechanism 7 includes a roller in contact with the fluid application outer tube 5 so as to reduce frictional resistance.

An outlet 8 is provided at the leading end of the fluid application outer tube 5. The outlet 8 is curved toward the inner circumferential surface of the centrifugal casting mold 2. A fluid supply tube 9 is inserted in the fluid application outer tube 5 in such a way as to be connected to the outlet 8. A coating material or the like is supplied to the fluid supply tube 9, and is blown out from the outlet 8 to the inner circumferential surface of the centrifugal casting mold 2. Note that the term "blowing out" is defined as a term that has meanings including "jetting" and "spraying".

The fluid application outer tube 5 includes a resin hollow tube 10 and a metal tube 11. The resin hollow tube 10 is molded of fiber-reinforced resin (CFRP). The metal tube 11 is made of stainless steel, and covers the outer circumferential surface of the resin hollow tube 10.

The fluid application outer tube 5 to be used in the centrifugal casting device 1 is long, and is inserted into the mold preheated to a high temperature to apply the fluid. Therefore, an insertion leading end side portion, which is a free end, of the fluid application outer tube 5 is likely to bend due to heat. However, it is possible to prevent the fluid application outer tube 5 from bending by using the fiber-reinforced resin (CFRP). In addition, the fluid application outer tube 5 includes not only the resin hollow tube 10 but also the metal tube 11 covering the outer circumferential surface of the resin hollow tube 10. As a result, it is possible not only to ensure the strength and abrasion resistance of the fluid application outer tube 5, but also to further prevent the fluid application outer tube 5 from bending due to the effect of heat.

The inner circumferential surface of the resin hollow tube 10 has a tapered shape increasing in diameter from the base end toward the leading end. The outer circumferential surface of the resin hollow tube 10 is formed such that the diameter of the resin hollow tube 10 is constant throughout its length between the base end and the leading end. Thus, the resin hollow tube 10 is formed in such a way as to be gradually thinned from the base end toward the leading end.

According to the present embodiment, the fluid application outer tube 5 includes the resin hollow tube 10 and the metal tube 11 covering the outer circumferential surface of the resin hollow tube. Therefore, even if the wall thickness of the metal tube 11 is reduced, the metal tube 11 can be supported by the resin hollow tube 10 formed by use of resin lighter than metal, so that the strength of the fluid application outer tube 5 can be ensured. In addition, even if the fluid application outer tube 5 is formed as a long tube, it is possible to ensure the strength of a base end side portion of the fluid application outer tube 5 and reduce weight to be put on the base end side portion by forming the fluid application outer tube 5 such that the base end side portion is thick and the leading end side portion is thin.

Furthermore, since the metal tube 11 is disposed on the outer circumferential surface, it is also possible to ensure resistance to abrasion caused by friction with the guide mechanism 7.

In addition, the inner circumferential surface of the resin hollow tube 10 has a tapered shape, and the resin hollow tube 10 becomes thinner from the base end toward the leading end. Meanwhile, the outer diameter of the resin hollow tube 10 is constant throughout its length between the base end and the leading end. Therefore, as compared with a case where the outer diameter of the resin hollow tube 10 is not constant throughout its length between the base end and the leading end, it is easy to cover the outer circumference of the resin hollow tube 10 with the metal tube 11 while reducing the weight of the leading end.

Note that, in the present embodiment, the metal tube 11 has been described which has a diameter constant throughout its length between the base end and the leading end. However, the metal tube of the present invention is not limited thereto, and the metal tube may be formed such that the leading end side portion is thinner than the base end side portion. For example, the base end side portion may be formed as a two-layer metal tube made of stainless steel, and the leading end side portion may be formed as a single-layer metal tube made of stainless steel. As a result, the leading end can be further thinned, and further weight reduction can be achieved.

In addition, although the metal tube 11 formed of stainless steel has been described in the present embodiment, the metal tube of the present invention is not limited thereto. For example, the metal tube may include a light metal portion made of aluminum and a heat-resistant metal portion covering the outer circumferential surface of the light metal portion and formed of a metal (for example, stainless steel)

having higher heat resistance than the light metal portion. As a result, it is possible to further reduce the weight of the fluid application outer tube while maintaining the heat resistance of the fluid application outer tube.

In addition, a cooling water pipe may be provided in the fluid application outer tube.

Moreover, the metal tube 11, which is made of stainless steel and covers the outer circumferential surface of the resin hollow tube 10, may be formed by the winding of sheet-shaped stainless steel around the outer circumferential surface of the resin hollow tube 10.

REFERENCE SIGNS LIST

1 centrifugal casting device
2 centrifugal casting mold
3 rail
4 fluid application device
5 fluid application outer tube
6 movable mechanism
7 guide mechanism
8 outlet
9 fluid supply tube
10 resin hollow tube
11 metal tube
12 control unit

The invention claimed is:

1. A fluid blow-out structure of a centrifugal casting device, for blowing out fluid to an inner surface of a rotating cylindrical mold, the structure comprising:

a fluid application outer tube that can be inserted into and removed from the mold;

a movable mechanism that supports a base end of the fluid application outer tube;

an outlet through which the fluid is blown out, the outlet being provided at a leading end of the fluid application outer tube;

a fluid supply tube inserted in the fluid application outer tube and connected to the outlet; and a guide mechanism that is in contact with an outer circumferential surface of the fluid application outer tube, and guides the fluid application outer tube into and out of the mold, wherein the fluid application outer tube includes a resin hollow tube and a metal tube that covers an outer circumferential surface of the resin hollow tube.

2. The fluid blow-out structure of a centrifugal casting device according to claim 1, wherein an inner circumferential surface of the resin hollow tube has a tapered shape increasing in diameter toward a leading end, and the outer circumferential surface of the resin hollow tube is formed in such a way as to keep a diameter of the resin hollow tube constant throughout its length between a base end and the leading end such that the resin hollow tube is gradually thinned from the base end toward the leading end.

3. The fluid blow-out structure of a centrifugal casting device according to claim 2, wherein the metal tube is formed such that a leading end side portion is thinner than a base end side portion.

4. The fluid blow-out structure of a centrifugal casting device according to claim 3, wherein the metal tube includes a light metal tube portion and a heat-resistant metal portion, the heat-resistant metal portion covering an outer circumferential surface of the light metal tube portion and being formed of metal having higher heat resistance than the light metal tube portion.

5. The fluid blow-out structure of a centrifugal casting device according to claim 2, wherein the metal tube includes a light metal tube portion and a heat-resistant metal portion, the heat-resistant metal portion covering an outer circumferential surface of the light metal tube portion and being formed of metal having higher heat resistance than the light metal tube portion.

6. The fluid blow-out structure of a centrifugal casting device according to claim 1, wherein the metal tube is formed such that a leading end side portion is thinner than a base end side portion.

7. The fluid blow-out structure of a centrifugal casting device according to claim 1, wherein the metal tube includes a light metal tube portion and a heat-resistant metal portion, the heat-resistant metal portion covering an outer circumferential surface of the light metal tube portion and being formed of metal having higher heat resistance than the light metal tube portion.

* * * * *